US007150049B1

(12) United States Patent
Fitch

(10) Patent No.: US 7,150,049 B1
(45) Date of Patent: Dec. 19, 2006

(54) AUTOMATIC TOILET SEAT CLOSER

(76) Inventor: Julian M. Fitch, 1234 Clover St., Rochester, NY (US) 14610

( * ) Notice: Subject to any disclaimer, the term of this patent is extended or adjusted under 35 U.S.C. 154(b) by 0 days.

(21) Appl. No.: 11/267,526

(22) Filed: Nov. 4, 2005

Related U.S. Application Data

(63) Continuation-in-part of application No. 10/389,462, filed on Mar. 14, 2003, now abandoned.

(60) Provisional application No. 60/365,102, filed on Mar. 18, 2002.

(51) Int. Cl.
*A47K 13/10* (2006.01)

(52) U.S. Cl. ..... 4/246.1; 4/248

(58) Field of Classification Search ..... 4/236, 4/240, 246.1, 248
See application file for complete search history.

(56) References Cited

U.S. PATENT DOCUMENTS

| | | | |
|---|---|---|---|
| 905,996 | A | 12/1908 | Davis |
| 4,984,666 | A | 1/1991 | Orii et al. |
| 4,995,120 | A | 2/1991 | Tager |
| 5,153,946 | A | 10/1992 | Yoke et al. |
| 5,388,281 | A | 2/1995 | Wiklund et al. |
| 5,546,612 | A | 8/1996 | Johnson |
| 5,570,478 | A | 11/1996 | Armstrong |
| 5,794,277 | A | 8/1998 | Jones |
| 5,852,831 | A | 12/1998 | Naughton et al. |
| 6,182,301 | B1 | 2/2001 | Krueger et al. |

*Primary Examiner*—Charles E. Phillips
(74) *Attorney, Agent, or Firm*—John M. Hammond; Patent Innovations LLC

(57) ABSTRACT

An apparatus for closing a member against a substantially horizontal surface of an object, wherein the member comprises a first end and a second end thereby defining a longitudinal axis of the member, and wherein the first end of the member is hingably attached by a first hinge and a second hinge to the substantially horizontal surface and the second end of the member is separated from the substantially horizontal surface with the longitudinal axis at a non-perpendicular angle to the substantially horizontal surface. The apparatus comprises a mechanical timing mechanism comprised of a housing, and a rotatable shaft extending outwardly from the housing, the mechanical timing mechanism adapted for providing a torque upon the rotatable shaft and the mechanical timing mechanism operatively connected to the horizontal surface of the object; a linkage operatively connected to the shaft of the mechanical timing mechanism and to the member, the linkage transmitting the torque applied by the mechanical timing mechanism on the rotatable shaft to provide a first force upon the member, the first force directed to bringing the longitudinal axis of the member from the non-perpendicular angle with the substantially horizontal surface to a perpendicular angle with the substantially horizontal surface; and a variable rate spring assembly for providing a second force upon the member that resists bringing the member into contact with the substantially horizontal surface.

17 Claims, 7 Drawing Sheets

AUTOMATIC TOILET SEAT CLOSER

CROSS-REFERENCE TO RELATED PATENT APPLICATIONS

This application is a continuation-in-part of patent application U.S. Ser. No. 10/389,462, filed on Mar. 14, 2003 now abandoned, which claims the benefit of the filing date of U.S. provisional patent application Ser. No. 60/365,102 filed Mar. 18, 2002. The disclosures of these United States patent applications are incorporated herein by reference.

This invention relates generally to devices with hinged covers, and more particularly to toilets with hinged seats and hinged covers.

BACKGROUND OF THE INVENTION

1. Field of the Invention

An automatic toilet seat closing device comprising a timing mechanism and a spring mechanism, which will automatically lower a raised toilet seat or other lid or seat-like member from a generally vertical, open position to a horizontal, closed position.

2. Description of Related Art

Heretofore, a number of patents and publications have disclosed methods and apparatus for pivoting a first object, which is attached to a second object, the relevant portions of which may be briefly summarized as follows:

U.S. Pat. No. 6,182,301 to Krueger et al, issued Feb. 6, 2001, discloses an apparatus and method for automatically pivoting a first member relative to a second member.

U.S. Pat. No. 4,995,120 to Tager, issued Feb. 26, 1991, discloses a toilet seat closing device utilizing an electric motor, a ratchet clutch, a spring, and a timer.

U.S. Pat. No. 5,388,281 to Wiklund et al, issued Feb. 14, 1995, discloses an automatic closure mechanism for a toilet seat comprising a toilet seat, a time-regulating dashpot, and springs.

U.S. Pat. No. 5,546,612 to Johnson issued Aug. 20, 1996, discloses an automatic toilet seat lowering apparatus including a lid, seat, springs, friction discs, and a clutch.

U.S. Pat. No. 4,984,666 to Orii et al., issued Jan. 15, 1991 discloses a speed governor for a toilet seat lowering apparatus including a one-way clutch mechanism for providing braking force on the toilet seat during descent.

U.S. Pat. No. 5,794,277 to Jones, issued Aug. 18, 1998, discloses an automatic toilet seat closing device including a plate member, a first hinge assembly, a first hinge member, a coupling mechanism, a gear, and a connection mechanism.

U.S. Pat. No. 905,996 to Davis, issued Dec. 8, 1908, discloses an automatic toilet seat raising apparatus including a pair of wound wire springs disposed on a hinge pin and engaged with the toilet seat so as to apply a raising force to the seat.

U.S. Pat. No. 5,570,478 to Armstrong, issued Nov. 5, 1996, discloses a toilet seat hinge assembly for automatically lowering a toilet seat including a spring resiliently biasing the hinge shaft to rotate from its up position to its down position, a flush detector for detecting when the toilet is flushed, a lock for locking the shaft against rotation, and a second spring to bias the toilet seat upwardly to slow the movement of the seat from the up position to the down position.

None of these prior art devices fully provides in a simple, low-cost apparatus, all of the functions and attributes that are desirable in a toilet seat closing apparatus, such functions and attributes being the ability to close a toilet seat without human intervention, within a predetermined amount of time, with the ability to adjust such amount of time, without significant audible noise, and with commencement of closing within a predetermined and adjustable amount of time after having been raised upright.

Accordingly, embodiments of the present invention are provided that meet at least one or more of the following objects of the present invention.

It is a further object of this invention to provide a device that will close a toilet seat cover without any human effort or contact.

It is an additional object of this invention to provide a device that will close a toilet seat and a toilet seat cover within a predetermined and adjustable amount of time.

It is yet another object of this invention to provide a toilet seat closing device, which can be retrofitted to any conventional toilet seat that is already installed and functional.

It is a further object of this invention to provide a toilet seat closing device, which can be incorporated into the original design and manufacture of the toilet seat or which may be retrofitted to an already installed toilet seat and lid.

It is a further object of this invention to provide the actions described noiselessly, or with a minimum of sound.

It is a further object of this invention to produce the actions described above within a limited time, after the seat (or cover) has been manually lifted to its upright position.

It is a further object of this invention to provide a toilet seat closing device which provides a descent resisting force that increases in a non-linear manner as the toilet seat descends to a lowered position.

SUMMARY OF THE INVENTION

In accordance with the present invention, there is provided an apparatus for closing a member against a substantially horizontal surface of an object, wherein the member comprises a first end and a second end thereby defining a longitudinal axis of the member, and wherein the first end of the member is hingably attached by a first hinge and a second hinge to the substantially horizontal surface and the second end of the member is separated from the substantially horizontal surface with the longitudinal axis at a non-perpendicular angle to the substantially horizontal surface. The apparatus comprises a mechanical timing mechanism comprised of a housing, and a rotatable shaft extending outwardly from the housing, the mechanical timing mechanism adapted for providing a torque upon the rotatable shaft and the mechanical timing mechanism operatively connected to the horizontal surface of the object; a linkage operatively connected to the shaft of the mechanical timing mechanism and to the member, the linkage transmitting the torque applied by the mechanical timing mechanism on the rotatable shaft to provide a first force upon the member, the first force directed to bringing the longitudinal axis of the member from the non-perpendicular angle with the substantially horizontal surface to a perpendicular angle with the substantially horizontal surface; and a variable rate spring assembly for providing a second force upon the member that resists bringing the member into contact with the substantially horizontal surface. The variable rate spring assembly comprises an elongated shaft extending from the first hinge to the second hinge, the shaft having a central axis perpendicular to the longitudinal axis of the member; and wound wire coil spring means disposed upon the elongated shaft for providing the second force upon the member wherein the second force increases at a nonlinear rate as the angle formed between the longitudinal axis of the member and the surface decreases.

In one embodiment, the wound wire coil spring means is comprised of a variable rate coil spring wound around the elongated shaft and including a first end engaged with the member and a second end engaged with the horizontal surface of the object. In another embodiment, the wound wire coil spring means is comprised of a plurality of coil springs wound around the elongated shaft, each of the coil springs including a first end engaged with the member, and a second end adapted for engagement with the horizontal surface of the object, wherein each of the second ends of the coil springs engages with the horizontal surface at a different angular position of the member during descent of the member to the horizontal surface of the object.

The plurality of springs may include a first coil spring and a second coil spring wound around the elongated shaft, each of the coil springs including a first end engaged with the member, and a second end adapted for engagement with the horizontal surface of the object, wherein the second end of the first coil spring engages with the horizontal surface at a different angular position of the member during descent of the member to the horizontal surface of the object than the second end of the second coil spring. The second end of the first coil spring is preferably engaged with the horizontal surface of the object when the member is perpendicular to the horizontal surface of the object.

The plurality of springs may further include a third coil spring wound around the elongated shaft, the third coil spring including a first end engaged with the member, and a second end adapted for engagement with the horizontal surface of the object, wherein the second ends of the first coil spring, the second coil spring, and the third coil spring each engage with the horizontal surface at a different angular position of the member during descent of the member to the horizontal surface. The engagement of the second ends of the coil springs may be staggered at equal angular intervals of the member with respect to the horizontal surface, i.e. for three springs, at 90 degrees, 60 degrees, and 30 degrees from the horizontal surface.

In one embodiment, the linkage of the rotatable shaft of the timing mechanism to the member is provided by a linkage arm. In another embodiment, the linkage of the rotatable shaft of the timing mechanism to the member is provided by a shaft coupling.

Aspects of the invention are based on the observation of problems with previous attempts to provide a simple, reliable, and inexpensive device for the automatic closing of a toilet seat or similar hinged lid or seat. One of the advantages of the invention is that the seat is always in its horizontal position, resting on the bowl, ready for use, except for a short period of time following the manual lifting of the seat to its vertical position. This period of time is determined by the timing mechanism in the invention, and may be as little as a few seconds or as much as sixty minutes (or more). Another feature of the present invention is that after the seat has been lifted, its operation can be interrupted at any time before the seat returns to its resting place on the bowl. For example, the seat can be manually lifted back up to its vertical position (any other position) or forced down to its resting position at any point in its motion without damage to the mechanism or its performance. Another feature of the invention is that the period of time required for the seat to return to its resting place on the bowl may be varied or changed.

The apparatus of the present invention is advantageous because in addition to achieving the desired function, it is simple and inexpensive compared to other approaches, and it can be constructed with readily available subcomponents, such as the timing mechanism.

BRIEF DESCRIPTION OF THE DRAWINGS

The invention will be described by reference to the following drawings, in which like numerals refer to like elements, and in which.

Figure 1:
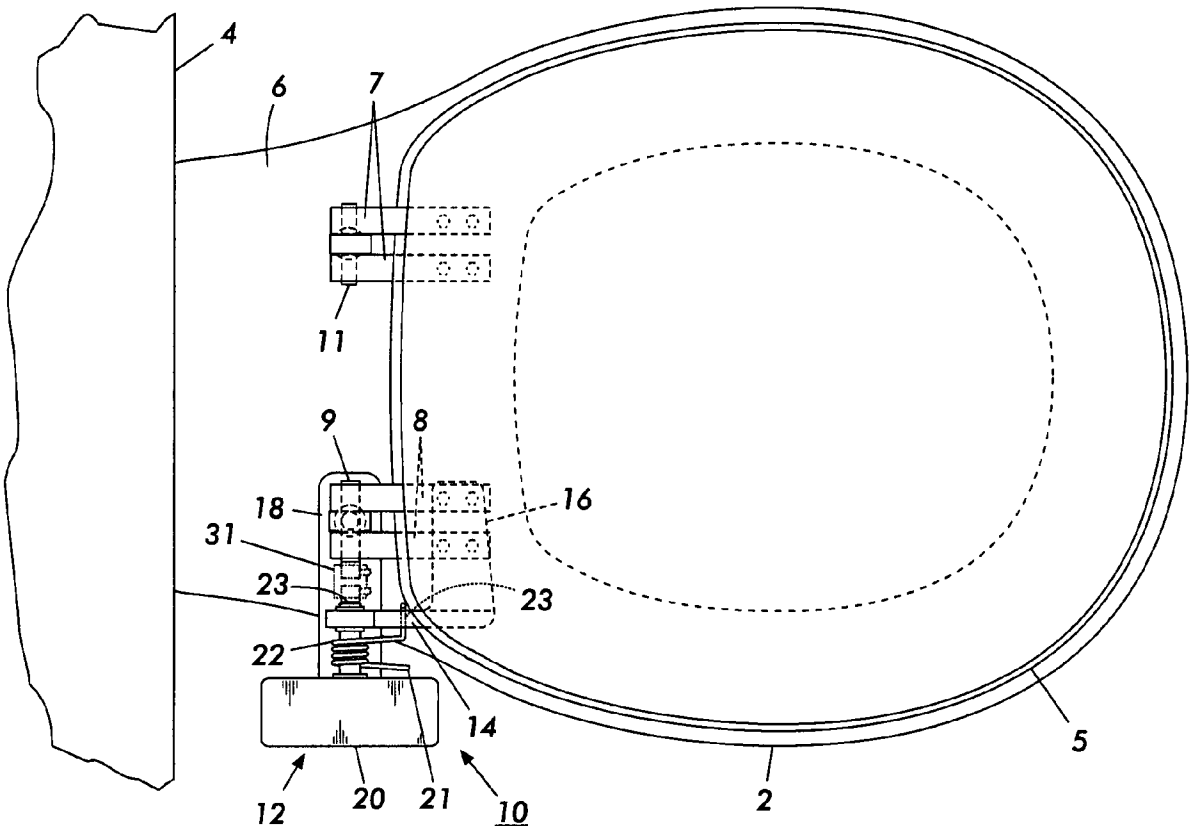
FIG. 1 is a top view of an embodiment of a toilet seat closing device in accordance with the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements. In describing the present invention, a variety of terms are used in the description. As used herein, the term "variable rate spring" is meant to indicate a spring in which the variation in force required to displace the spring (in compression, tension, or torsion, depending upon the spring configuration) is non-linear with respect to displacement. This is in contrast with a spring which obeys Hooke's law, i.e. the force F to displace the spring is linear with displacement x, i.e. $F=-kx$, where k is known as the "spring constant."

Referring to FIG. 1, one embodiment of the toilet seat closing device 10 comprises a mechanical timing mechanism 12, linkage 14, a first fastening bracket 16, and a second fastening bracket 18. Mechanical timing mechanism 12 further comprises mechanical clutches (not shown), shaft 23, and housing 20.

In the preferred embodiment, mechanical timing mechanism 12 is preferably substantially similar to a simple hand-wound timer commonly used in residential and light-duty industrial electrical circuits. Such timers are manufactured with friction clutches, and capable of timing intervals from a few seconds to tens of minutes. In the present invention, the electrical connections in such timers are unnecessary, since no electrical power is involved. In like manner, the handle that winds the timer, and the clock face are also unnecessary. The only parts of such a commercial timer, that are used in mechanical timing mechanism 12 of FIG. 1 are the clockworks and escapement, the drive spring, the friction clutch, and a housing.

It will, therefore, be appreciated that the embodiment depicted may include a variable or adjustable timer mechanism such that after the seat has been lifted, its operation can be interrupted at any time before the seat returns to its resting place on the bowl. Moreover, the period of time required for the seat to return to its resting place on the bowl may be varied or changed by the substitution of another timer element, or adjustment thereof (e.g., pre-winding the timer to vary the speed at which the seat or lid is returned to its closed position on the bowl).

It will be further appreciated by those skilled in the mechanical engineering arts, that the timer mechanism 12 may also be somewhat displaced from the hinge position, and that a cam and lever-arm arrangement may be used to operatively associate the timing mechanism with the seat or lid 5. In such an embodiment, the presence of the cam and lever arm, and alternatively a gear assembly (not shown), may be sufficient to provide the timing mechanism with sufficient mechanical advantage so as to allow a heavy seat or lid to be controlled by the timing mechanism.

Figure 2:
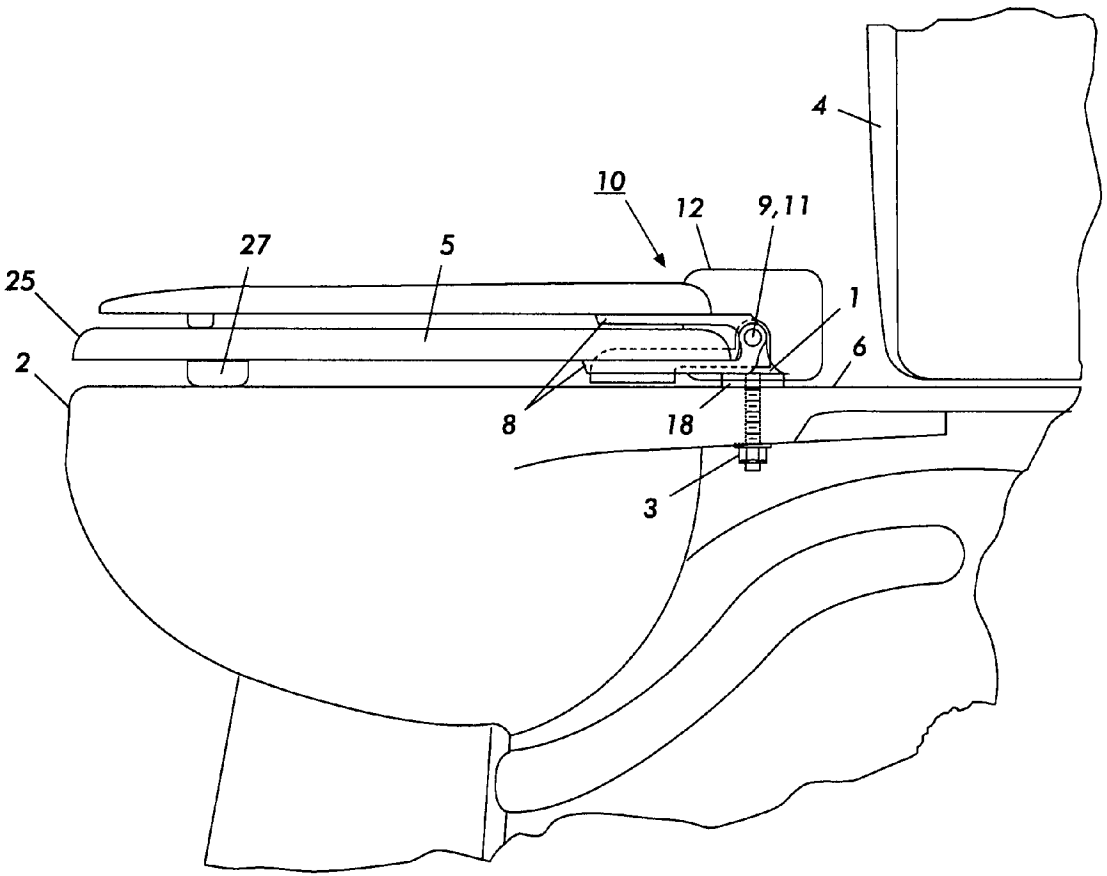
FIG. 2 is a side elevation view of the toilet seat closing device of FIG. 1.

Referring to FIG. 2, mechanical timing mechanism 12 is mounted such that the shaft on which the winding handle would be mounted (if there were a handle) is aligned with the central axes of hinge pins 9 and 11. The shaft of mechanism 12 must be suitably attached to toilet seat 5 in order to effect the rotation of toilet seat 5 about hinge pins 9 and 11 from the up (open) position, to the down (closed) position. In one embodiment, hinge pin 9 extends outwardly toward the shaft 23 of mechanism 12, such that the end of hinge pin 9 and the end of shaft 23 are proximate to each other. Hinge pin 9 and shaft 23 are suitably operatively joined with each other by shaft coupling 31. Hinge pin 9 is also suitably operatively joined to hinge arm 8, which is further joined to toilet seat 5, such that when the shaft 23 of mechanism 12 rotates, toilet seat 5 is correspondingly forced to rotate about both hinge pins 9 and 11 in an opening and closing motion.

Referring again to FIG. 1, in an alternative embodiment, shaft 23 of mechanism 12 is suitably operatively joined to linkage arm 14, which further comprises mounting bracket 16. Mounting bracket 16 is suitably joined to toilet seat by screws (not shown), adhesive, or other common fastening methods. It will be apparent that in like manner to the previous embodiment, when the shaft 23 of mechanism 12 rotates, toilet seat 5 is correspondingly forced to rotate about hinge pins 9 and 11 in an opening and closing motion.

Mechanical timing mechanism 12 thus provides the function of applying a torque to the shaft 23 thereof, in a rotational direction such that a first force is applied on hinge arm 8 and/or linkage arm 14, which in turn transmits such force to toilet seat 5. This first force results in the movement of toilet seat 5 from its raised resting position, which is slightly past perpendicular to the substantially horizontal flat surface 6 of toilet bowl 2, to a position that is perpendicular to surface 6. At this initial stage of toilet seat closing, this first force is working against the gravitational force on the toilet seat that resists this slight raising of the seat to the perpendicular position. Mechanical timing mechanism 12 is unitary, in that the components thereof, including a drive spring (not shown), a friction clutch (not shown), a housing 20, and a shaft 23 to which torque is applied, are all provided in a single mechanism.

Referring again to FIG. 1, mechanical timing mechanism 12 is also operatively connected to toilet bowl 2. Mechanical timing mechanism 12 may be directly connected to toilet bowl 2 by suitable fastening means. For example, if mechanical timing mechanism 12 comprises mounting brackets integrally formed therewith for mounting such mechanism 12 on a surface, such mechanism 12 may be secured to such surface with threaded fasteners.

In one embodiment, mechanical timing mechanism further comprises mounting bracket 18, which is secured between flat surface 6 of bowl 2 and hinge base 1, through the use of nut and bolt assembly 3. Nut and bolt assembly 3 are commonly used in practice to secure a first end of a toilet seat and hinge assemblies attached thereto to toilet bowls. It will be apparent that other means may be used to suitably operatively join timing mechanism 12 to bowl 2, such as adhesive means and the like.

Because of the manner in which mechanism 12 is joined to toilet bowl 2 and toilet seat 5, mechanism 12 applies a torque around the axes of hinge pins 9 and 11 of FIG. 2, resulting in the rotation of toilet seat 5 around hinge pins 9 and 11 in a closing motion, from the generally vertical upright position to the horizontal closed position. It will be apparent that in the operation of slowly lowering the toilet seat from an open, vertical position, to a closed, horizontal position, the minimal force will be required when the toilet seat is in the vertical position. This force at this point in time will be substantially the force required to overcome the frictional resistance of the toilet seat hinges; when the toilet seat is in the vertical position, it is momentarily substantially balanced on its hinge pins. It will be appreciated that, in some applications for the present invention, a toilet tank may not be positioned so as to stop the motion of the seat and lid at a generally vertical orientation, but that the seat and lid may be somewhat past vertical. Accordingly, it is further contemplated that the present invention have sufficient torque provided by timing mechanism 12, or operatively associated springs (not shown), to start the "closing" of the seat and/or lid when the same are raised beyond the vertical position (i.e. an obtuse angle).

It will be further apparent that as the toilet seat is slowly rotated toward a closed position, the timing mechanism will be required to provide a second force on the toilet seat which resists the force of gravity, in order to effect the lowering of the seat in a slow and controlled manner. The point at which the maximum resisting force is required is at the instant before the toilet seat reaches its closed horizontal position (see FIG. 2), wherein the end 25 of toilet seat 5 is in a substantially horizontally cantilevered position. As used herein, end 25 is meant to include a portion of toilet seat 5 including resting pad 27, such that the contact of pad 27 with surface 6 of bowl 2 represents the closed position.

If the toilet seat is of a sufficiently lightweight material, or if the spring and clutches in the timing mechanism 12 of FIG. 1 impart sufficient resistance to the rotation of shaft 23, then the invention as described herein will comprise a satisfactory toilet seat lowering device. However, common toilet seats often comprise dense material, and mechanical timing mechanisms that are low cost may not provide or accommodate substantial torque upon their output shafts. It is therefore desirable to provide a means of assisting the resisting force required to effect the slow and controlled lowering of a toilet seat.

Accordingly, in a further embodiment of the present invention, there is provided spring means to assist in the controlled lowering of a toilet seat. Referring to FIG. 1, spring 22 is fitted to timing mechanism 12. In the embodiment shown in FIG. 1, spring 22 is a wound wire spring, with a first end 21 secured to clutch housing 20 or resting against bracket 18 that functions as a stop, and a second end 23 secured to linkage 14, or alternatively (and equivalently in function), to toilet seat 5. In operation, spring 22 provides a counterbalancing force, which supports most of the weight of the toilet seat as it closes. Thus timing mechanism 12 must only provide a correspondingly small portion of the force required to effect the slow and controlled lowering of the toilet seat. In an alternate embodiment wherein shaft 23 extends beyond linkage arm 14, and spring 22 is disposed on such extension, end 21 rests against surface 6 of toilet bowl 2, which functions as a stop.

In the operation of typical spring, the force required to compress or extend the spring a short distance is linearly proportional to the distance compressed or extended. This principle applies to the operation of a wound spring, where distance is angular displacement. It will be apparent as described earlier regarding the operation of applicant's toilet seat closing device, that the minimal spring assistance force will be required when the toilet seat is in the vertical position and the maximum spring assisting force will be required at the instant before the toilet seat reaches its closed horizontal position. It will be further apparent that the change in required assistance force is not a linear function of angular displacement of the toilet seat from its vertical position to its horizontal position, but instead increases at a non-linear rate as the horizontal location of the center of mass of the toilet seat becomes increasingly further from hinge pins 9 and 11, about which toilet seat 5 rotates. In general, the net force of gravity on the toilet seat 5 as it descends is proportional to the cosine of the angle between the toilet seat 5 and the horizontal surface 6 of the toilet bowl 2.

Accordingly, in one embodiment of the present invention, a variable rate spring is used as spring 22 of FIG. 1, wherein the assisting force provided by spring 22 closely corresponds with the angular-dependent force required to support the toilet seat as it is lowered from its vertical position to its horizontal position. Variable rate springs are well known in the art. In the fabrication of wire wound springs, a variable rate may be achieved by increasing or decreasing the diameter of the wire along its length; or increasing or decreasing the overall diameter of the coil winding along the length of the spring; or other known methods.

Figure 3:
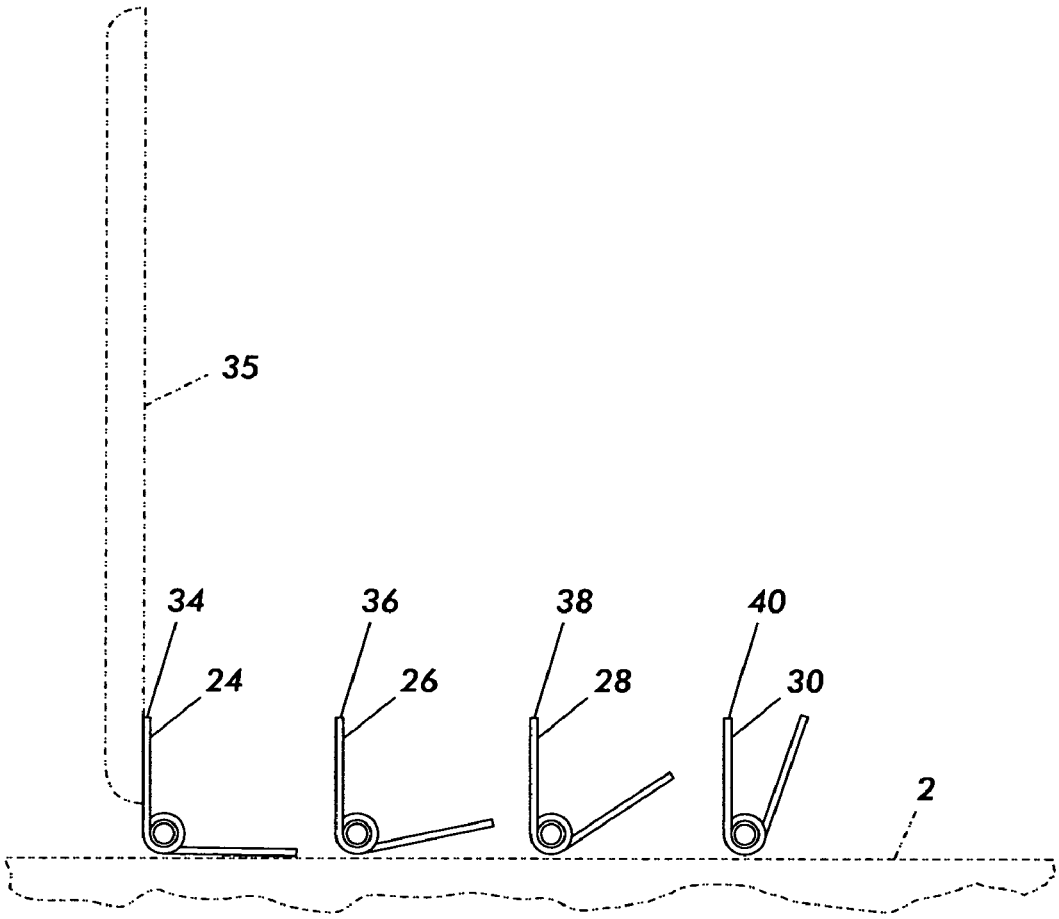
FIG. 3 is a side elevation view of another embodiment of the present invention, including a series of resistance springs to assist in the operation of the present invention.

In a further embodiment, a plurality springs may be used to achieve substantially the same result as a variable rate spring. Referring to FIG. 3, springs 24, 26, 28, and 30 are suitably attached to toilet bowl 2. As toilet seat 5 is lowered from its vertical position to its horizontal position, spring tips 34, 36, 38, and 40 of springs 24, 26, 28, and 30, respectively, are sequentially contacted by toilet seat 5, providing the desired increasing resistance force to the closure of toilet seat as it approaches the closed position.

In the examples provided in FIG. 1 through FIG. 3, wire wound springs are shown as providing the resisting support for the closing of toilet seat 5. It will be apparent that many other spring configurations could be utilized, which would achieve substantially the same result. For example, one could utilize one or more of a leaf spring, a spring comprising a sector of a toroid; or a torsion type spring disposed between the pair of hinges 7 and 8 of FIG. 1, and substantially coaxial with each of the pins 9 and 11 of hinges 7 and 8, respectively. Furthermore it is not required that the springs be exclusively of metal. The use of an elastomer as a spring material could also be suitable.

In general, any spring or plurality of springs, which will provide a satisfactory resisting force during the lowering of the toilet seat from its vertical position to its horizontal position, such that the mechanical timing mechanism can provide a slow and controlled lowering, will be suitable.

Figure 5:
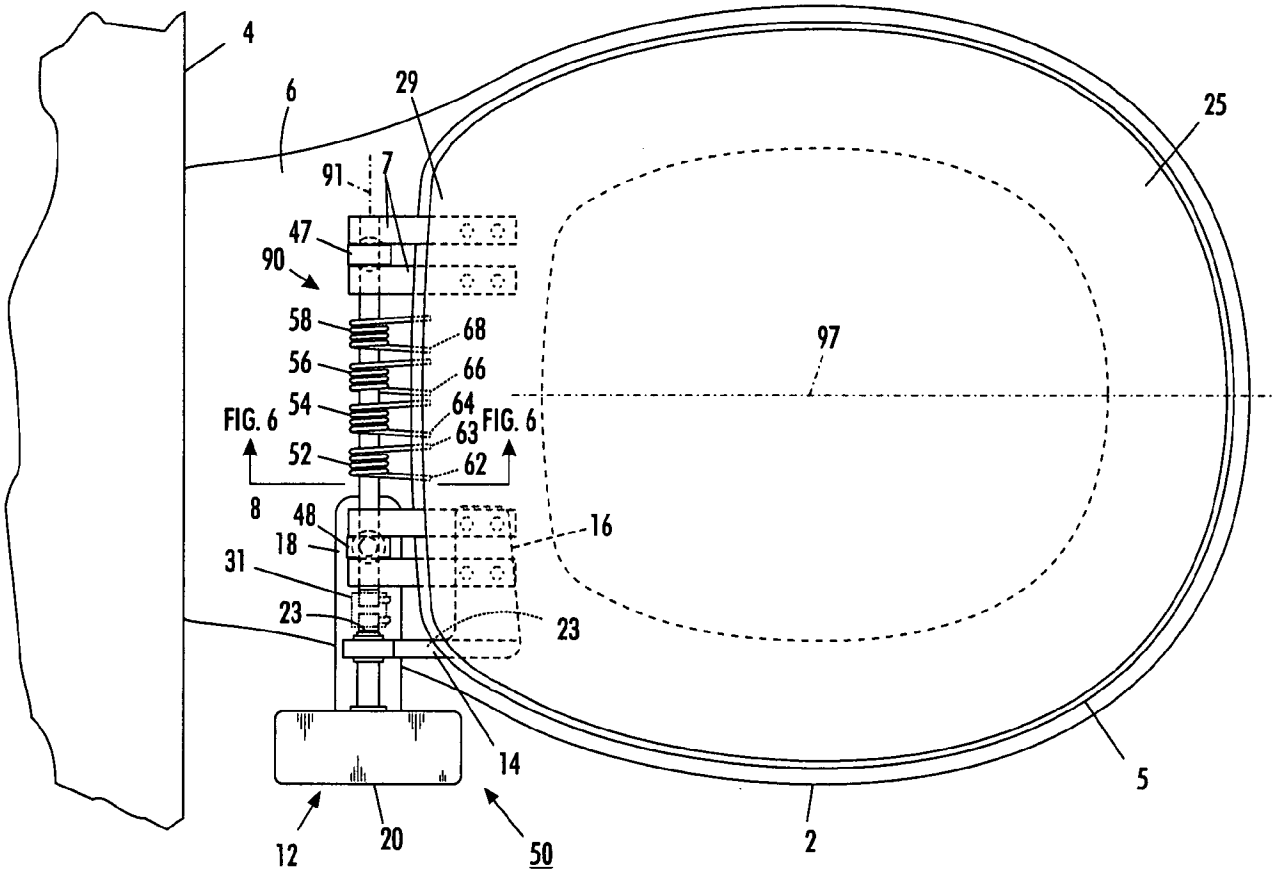
FIG. 5 is a top view of another embodiment of a toilet seat closing device comprising a plurality of coil springs wound around an elongated shaft adapted for providing a second force upon a toilet seat that resists bringing the toilet seat into contact with the toilet bowl, the toilet seat of FIG. 5 being depicted in the closed position.
Figure 6:
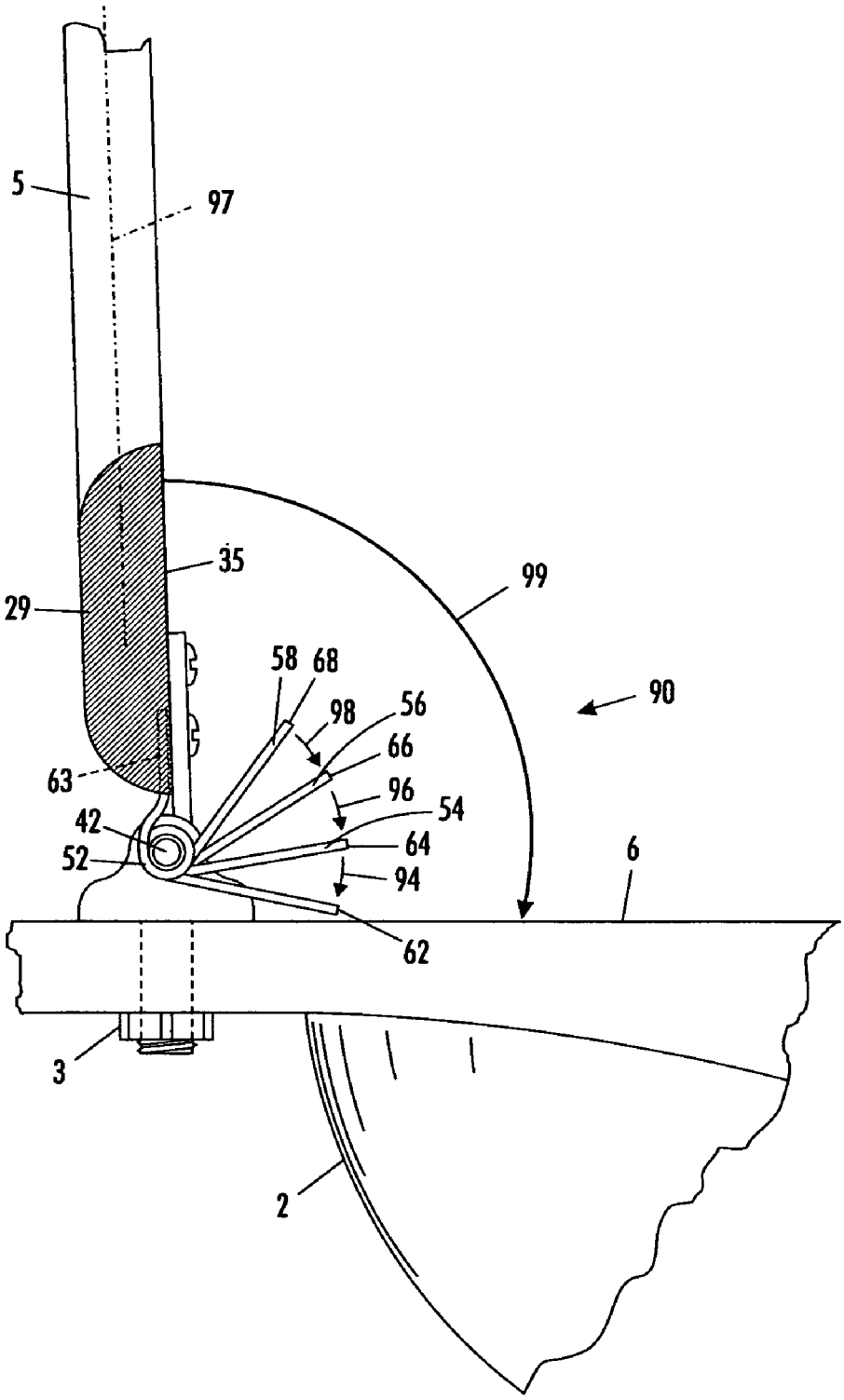
FIG. 6 is a side elevation view of a portion of the device of FIG. 5 taken along line 6—6 of FIG. 5 and depicting the plurality of coil springs wound around the elongated shaft, but with the toilet seat of FIG. 5 being depicted in the raised position.

Further embodiments of the present invention are directed to the use of a plurality of springs, or a single variable rate spring to provide a force upon the toilet seat that resists bringing the seat into contact with the substantially horizontal surface of the toilet bowl. The first of such embodiments comprises a plurality of springs to provide such resisting force. FIG. 5 is a top view of another embodiment of a toilet seat closing device comprising a plurality of coil springs wound around an elongated shaft adapted for providing a second force upon a toilet seat that resists the force of gravity that brings the toilet seat into contact with the toilet bowl, the toilet seat of FIG. 5 being depicted in the closed position. FIG. 6 is a side elevation view of a portion of the device of FIG. 5 taken along line 6—6 of FIG. 5 and depicting the plurality of coil springs wound around the elongated shaft, but with the toilet seat of FIG. 5 being depicted in the raised position.

Referring to FIGS. 5 and 6, toilet seat closing apparatus 50 is adapted for closing seat 5 against the substantially horizontal surface 6 of toilet bowl 2, wherein the toilet seat 5 comprises a first end 29 and a second end 25 thereby defining a longitudinal axis 97 of the toilet seat 5, and wherein the first end 29 of the toilet seat is hingably attached by a first hinge 47 including hinge arms 7, and a second hinge 48 including hinge arms 8, to the substantially horizontal surface 6; and the second end 25 of the toilet seat 5 is separated from the substantially horizontal surface 6 with the longitudinal axis 97 at a non-perpendicular angle to the substantially horizontal surface 6. The apparatus 50 comprises a mechanical timing mechanism 12 comprised of a housing 20, and a rotatable shaft 23 extending outwardly from the housing 20. The mechanical timing mechanism 20 is adapted for providing a torque upon the rotatable shaft 23, and is operatively connected to the horizontal surface 6 of the object, preferably by a bracket 18, although other suitable connection means may be used for this purpose.

Apparatus 50 further comprises a linkage operatively connected to the shaft 23 of the mechanical timing mechanism and to the toilet seat 5, the linkage transmitting the torque applied by the mechanical timing mechanism 20 on the rotatable shaft 23 to provide a first force upon the toilet seat 5. This first force is directed to bringing the longitudinal axis 97 of the toilet seat 5 from the non-perpendicular angle with the substantially horizontal surface 6 (i.e. the "seat raised" resting position) to a perpendicular angle with the substantially horizontal surface 6, and subsequently closed against the substantially horizontal surface 6 of the toilet bowl 2 as depicted in FIG. 5. In one embodiment, the linkage of the rotatable shaft 23 of the timing mechanism 20 to the toilet seat 5 is provided by a linkage arm 14 as previously described herein. In another embodiment, the linkage of the rotatable shaft of the timing mechanism to the toilet seat 5 is provided by a shaft coupling 31 as previously described herein.

Apparatus 50 further comprises a variable rate spring assembly 90 for providing a second force upon the toilet seat 5 that resists bringing the toilet seat 5 into contact with the substantially horizontal surface 6. The variable rate spring assembly 90 comprises an elongated shaft 42 extending from the first hinge 47 to the second hinge 48, the shaft 42 having a central axis 91 perpendicular to the longitudinal axis 97 of the toilet seat 5; and wound wire coil spring means disposed upon the elongated shaft 42 for providing the second force upon the toilet seat 5, wherein the second force increases at a nonlinear rate as the angle formed between the toilet seat 5 and the surface decreases during the closing of the seat indicated by arcuate arrow 99. Elongated shaft may also serve to replace the pins of hinges 47 and 48, such hinge pins being as hinge pins 9 and 11 of FIG. 1.

In the embodiment depicted in FIGS. 5 and 6, the wound wire coil spring means is comprised of a plurality of coil springs wound around the elongated shaft 42, each of the coil springs including a first end engaged with the toilet seat 5, and a second end adapted for engagement with the horizontal surface 6 of the toilet bowl 2, wherein each of the second ends of the coil springs engages with the horizontal surface at a different angular position of toilet seat 5 during descent of the toilet seat 5 to the horizontal surface 6 of the toilet bowl. The plurality of springs includes, at minimum, a first coil spring and a second coil spring wound around the elongated shaft, each of the coil springs including a first end engaged with the toilet seat 5, and a second end adapted for engagement with the horizontal surface 6 of the toilet bowl 5, wherein the second end of the first coil spring engages with the horizontal surface at a different angular position of the toilet seat 5 during descent of the toilet seat 5 to the horizontal surface of the bowl 2 than the second end of the second coil spring.

In the embodiment depicted in FIGS. 5 and 6, apparatus 50 comprises four coil springs 52, 54, 56, and 58 wound around elongated shaft 42. The first ends of springs 52, 54, 56, and 58, such as e.g., end 63 of spring 52 are engaged with toilet seat 5. In the embodiment depicted in FIGS. 5 and 6, end 63 of spring 52 is embedded in end 29 of toilet seat 5. Alternatively, end 63 could be disposed along the lower surface 35 of toilet seat 5. When toilet seat 5 is lowered, the second ends 62, 64, 66, and 68 of the first coil spring 52, the second coil spring 54, and the third coil spring 56, and the fourth coil spring 58, respectively, each engage with the horizontal surface 6 of toilet bowl 2 at a different angular position of the toilet seat 5 during descent of the toilet seat 5 to the horizontal surface. The motion of the second ends 64, 66, and 68 of springs 54, 56, and 58 during the lowering of toilet seat 5 are indicated in FIG. 6 by arcuate arrows 94, 96, and 98, respectively. It can be seen that at the beginning of the lowering process, i.e. when toilet seat 5 is approximately perpendicular to horizontal surface 6, end 62 of spring 52 is engaged with horizontal surface 6 of toilet bowl 2, and immediately begins to provide a force that resists the lowering of toilet seat 5.

In one embodiment, the engagement of the second ends 62, 64, 66, and 68 of the coil springs 52, 54, 56, and 58 may be staggered at equal angular intervals of the toilet seat 5 with respect to the horizontal surface 6, i.e. for these four springs, at about 90 degrees, 67.5 degrees, 45 degrees, and 22.5 degrees from the horizontal surface 2. In like manner, for an apparatus using three springs, such angular intervals could be spaced at 90 degrees, 60 degrees, and 30 degrees from the horizontal surface 2. It will be apparent that the apparatus could be configured in a similar manner with five or more springs, as available space along elongated shaft 42 permits.

Figure 7:
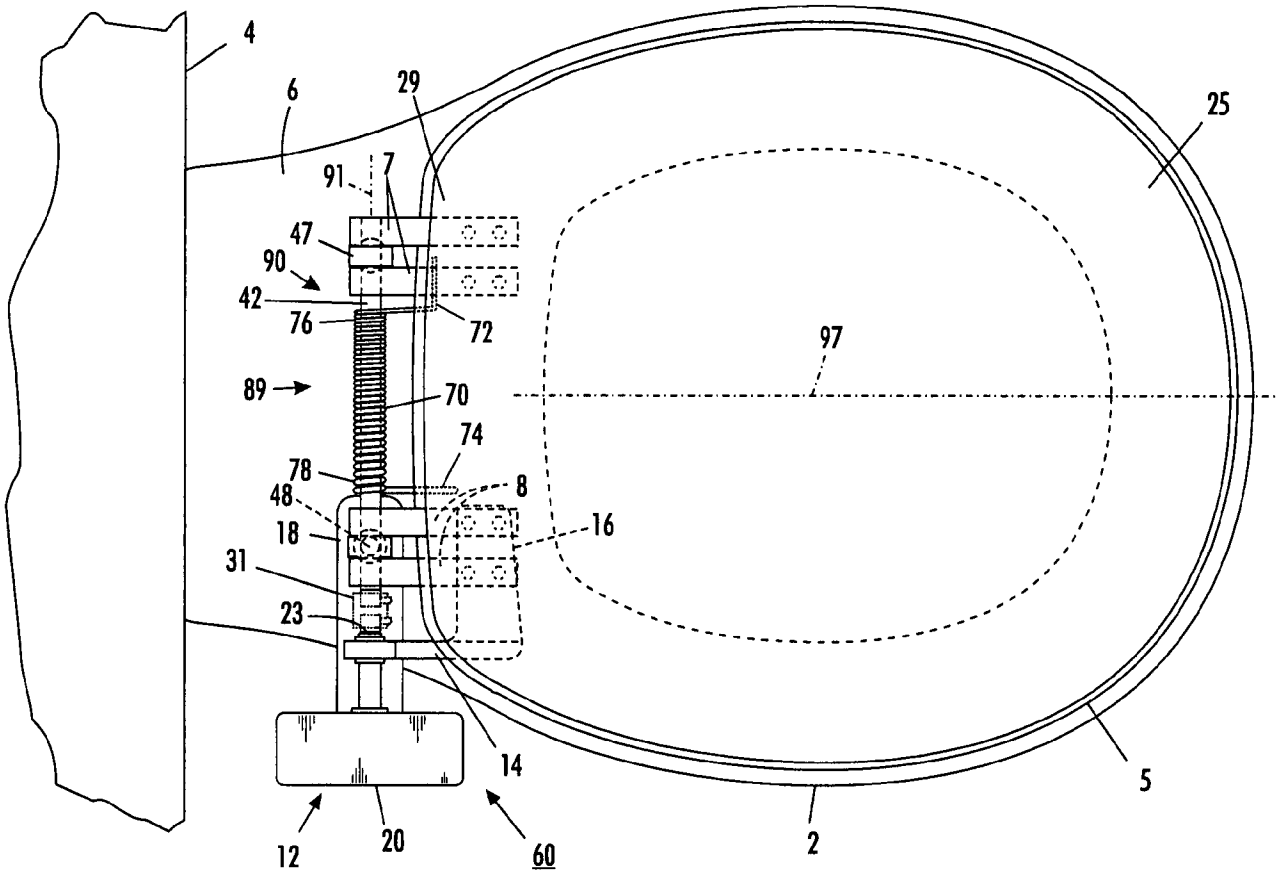
FIG. 7 is a top view of another embodiment of a toilet seat closing device comprising a single variable rate spring wound around an elongated shaft adapted for providing a second force upon a toilet seat that resists bringing the toilet seat into contact with the toilet bowl, the toilet seat of FIG. 7 being depicted in the closed position.

FIG. 7 is a top view of another embodiment of a toilet seat closing device comprising a variable rate spring assembly for providing a second force upon a toilet seat that resists bringing the toilet seat into contact with the toilet bowl, the toilet seat of FIG. 7 being depicted in the closed position. Apparatus 60 of FIG. 7 is similar to apparatus 50 of FIGS. 5 and 6, with the difference being in certain components of the variable rate spring assembly. Like apparatus 50 of FIGS. 5 and 6, apparatus 60 of FIG. 7 comprises a variable rate spring assembly 90 for providing a second force upon the toilet seat 5 that resists bringing the toilet seat 5 into contact with the substantially horizontal surface 6. The variable rate spring assembly 90 comprises an elongated shaft 42 extending from the first hinge 47 to the second hinge 48, the shaft 42 having a central axis 91 perpendicular to the longitudinal axis 97 of the toilet seat 5; and wound wire coil spring means disposed upon the elongated shaft 42 for providing the second force upon the toilet seat 5, wherein the second force increases at a nonlinear rate as the angle formed between the toilet seat 5 and the surface decreases during the closing of the seat 5 indicated by arcuate arrow 99 (see also FIG. 6).

In differing from apparatus 50 of FIGS. 5 and 6, the variable rate spring assembly 89 of apparatus 60 of FIG. 7 is comprised of a single variable rate coil spring 70 wound around the elongated shaft 42. Variable rate spring 70 includes a first end 72 that is engaged with the toilet seat 5 (or with hinge arm 7, which is engaged with toilet seat 5), and a second end 74 that engaged with the horizontal surface 6 of the toilet bowl 2. Variable rate spring 70 thus provides a similar function to the plurality of springs used in apparatus 50 of FIGS. 5 and 6, i.e. a second force upon the toilet seat 5, wherein the second force increases at a nonlinear rate as the angle formed between the toilet seat 5 and the surface 6 decreases during the closing of the seat 5.

In the embodiment depicted in FIG. 7, the spring rate of variable rate spring 70 is made variable by virtue of a gradual increase in the diameter of the spring wire along the length of the spring. It can be seen that wire coil 76 of spring 70 is smaller in diameter than wire coil 78 of spring 70, and that the diameter of the wire of spring 70 increases in the direction along axis 91 from hinge 47 to hinge 48.

The operation of the apparatus of the invention is now described, with reference in particular to FIG. 1, 5, or 7. To initiate the operation of the present invention, the toilet seat 5 is manually lifted to substantially a vertical position. Typically, toilet seat 5 is positioned slightly past a vertical position and rests against tank 4. This manual lifting action winds the internal timer spring of mechanical timing mechanism 12. Mechanism 12 may be previously adjusted to provide a variable, preferably short, time delay between about 15 seconds and about thirty minutes, during which no action occurs. Such time delay is preferably between about thirty seconds and about fifteen minutes, and more preferably between about one minute and about five minutes. Subsequent to this time delay, mechanical timing mechanism 12 rotates toilet seat 5 through the vertical position, and lowers toilet seat 5 to its horizontal position against bowl 2 in a slow, controlled, and quiet manner. Toilet seat 5 remains closed, resting on bowl 2, until toilet seat 5 is manually lifted again into the vertical position, wherein the cycle is repeated.

Without wishing to be bound to any particular theory, the applicant believes that apparatus 50 and 60 of FIGS. 5, 6, and 7 are advantageous in that they provide a relatively small resisting force in the early stage of toilet seat lowering, i.e. at angles between about 60 degrees and 90 degrees, and then a rapidly increasing force in later stages of toilet seat lowering, i.e. between angles of about 60 degrees and 0 degrees, and particularly between about 30 degrees and 0 degrees. Since the gravitational force on the toilet seat is proportional to the cosine of the seat angle as previously described, the gravitational force increases more rapidly in the early stage of seat lowering. Thus the applicant's apparatus of FIGS. 5, 6, and 7, provide the required seat lowering resistance late in the cycle of lowering where it is needed to bring the seat to rest gently, while allowing the seat to descend quickly in the early stage of lowering. The applicant's apparatus thus enables the toilet seat to be lowered quickly, while bringing it to a gentle stop against the toilet bowl. In these embodiments, the mechanical timing mechanism 20 of the apparatus does not provide significant resistance force opposing the lowering of the toilet seat 5.

In a further embodiment, (not shown), the toilet comprises a bowl, a toilet seat, and a toilet seat cover; and accordingly, the present invention further comprises an additional closing device, perhaps mounted proximate to hinge pin 11 or the other hinge assembly, as described herein, for closing the toilet seat cover, after the closing of the toilet seat.

Figure 4:
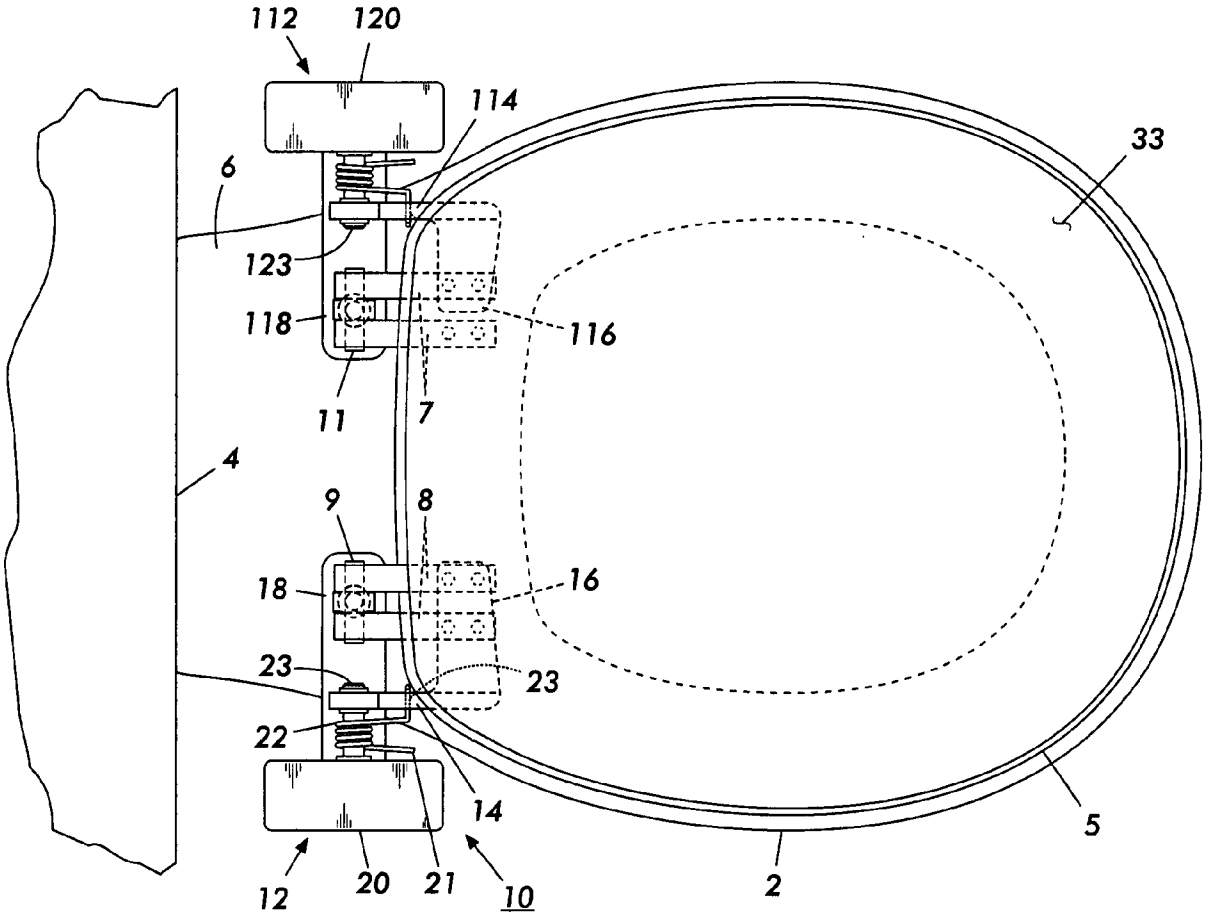
FIG. 4 is a top view of an embodiment of a toilet seat closing device in accordance with the present invention, further comprising an additional mechanism to lower and close a toilet seat cover onto a toilet seat.

FIG. 4 is a top view of an embodiment of a toilet seat closing device in accordance with the present invention, further comprising an additional mechanism to lower and close a toilet seat cover onto a toilet seat. Referring to FIG. 4, applicant's toilet seat closing apparatus further comprises mechanism 112 comprising housing 120 and output shaft 123, mounted on bracket 118. Shaft 123 of mechanism 112 is suitably operatively joined to linkage arm 114, which further comprises mounting bracket 116. Mounting bracket 116 is suitably joined to toilet seat cover 33 by screws (not shown), adhesive, or other common fastening methods.

It will be apparent that the operation of mechanism 112 to lower toilet seat cover 33 downwardly to toilet seat 5 occurs in substantially the same manner as previously described for the lowering of toilet seat 5 to toilet bowl 2 by mechanism 12. Such lowerings may occur simultaneously, or there may be a pre-programmed time delay between the closing of the seat 5 to bowl 2, and the closing of the cover 33 to the seat 5. It will be further apparent that the apparatus 50 and 60 of FIGS. 5, 6, and 7 are also applicable to the lowering of a toilet seat, and subsequently a toilet seat cover.

It is, therefore, apparent that there has been provided, in accordance with the present invention, an apparatus for the automated closing of a toilet seat. The apparatus of the present invention has been describe as useful for such a closing of a toilet seat, but is not limited solely to such closing of such an object. Insomuch as a toilet may be considered as comprising a first member, a seat, and a second member, a bowl having a surface, the apparatus of the present invention provides for the closing of a first member hingably attached to a second member. Accordingly, numerous other applications of the present invention to objects comprising hingably attached members will be apparent, and are to be considered within the scope of the present invention.

While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for closing a member against a substantially horizontal surface of an object, wherein said member comprises a first end and a second end thereby defining a longitudinal axis of said member, and wherein said first end of said member is hingably attached by a first hinge and a second hinge to said substantially horizontal surface and said second end of said member is separated from said substantially horizontal surface with said longitudinal axis at a non-perpendicular angle to said substantially horizontal surface, said apparatus comprising:

a. a mechanical timing mechanism comprised of a housing, and a rotatable shaft extending outwardly from said housing, said mechanical timing mechanism adapted for providing a torque upon said rotatable shaft and said mechanical timing mechanism operatively connected to said horizontal surface of said object;

b. a linkage operatively connected to said shaft of said mechanical timing mechanism and to said member, said linkage transmitting said torque applied by said mechanical timing mechanism on said rotatable shaft to provide a first force upon said member, said first force directed to bringing said longitudinal axis of said member from said non-perpendicular angle with said substantially horizontal surface to a perpendicular angle with said substantially horizontal surface;

c. a variable rate spring assembly for providing a second force upon said member that resists bringing said member into contact with said substantially horizontal surface, said variable rate spring assembly comprising:

i. an elongated shaft extending from said first hinge to said second hinge, said shaft having a central axis perpendicular to said longitudinal axis of said member;

ii. wound wire coil spring means disposed upon said elongated shaft for providing said second force upon said member wherein said second force increases at a nonlinear rate as the angle formed between said longitudinal axis of said member and said surface decreases.

2. The apparatus as recited in claim 1, wherein said wound wire coil spring means is comprised of a variable rate coil spring wound around said elongated shaft and including a first end engaged with said member and a second end engaged with said horizontal surface of said object.

3. The apparatus as recited in claim 1, wherein said wound wire coil spring means is comprised of a plurality of coil springs wound around said elongated shaft, each of said coil springs including a first end engaged with said member, and a second end adapted for engagement with said horizontal surface of said object, wherein each of said second ends of said coil springs engages with said horizontal surface at a different angular position of said member during descent of said member to said horizontal surface of said object.

4. The apparatus as recited in claim 1, wherein said wound wire coil spring means is comprised of a first coil spring and a second coil spring wound around said elongated shaft, each of said coil springs including a first end engaged with said member, and a second end adapted for engagement with said horizontal surface of said object, wherein said second end of said first coil spring engages with said horizontal surface at a different angular position of said member during descent of said member to said horizontal surface of said object than said second end of said second coil spring.

5. The apparatus as recited in claim 4, wherein said second end of said first coil spring is engaged with said horizontal surface of said object when said member is perpendicular to said horizontal surface of said object.

6. The apparatus as recited in claim 4, further comprising a third coil spring wound around said elongated shaft, said third coil spring including a first end engaged with said member, and a second end adapted for engagement with said horizontal surface of said object, wherein said second ends of said first coil spring, said second coil spring, and said third coil spring each engage with said horizontal surface at a different angular position of said member during descent of said member to said horizontal surface.

7. The apparatus as recited in claim 6, wherein said second end of said first coil spring is engaged with said horizontal surface of said object when said member is perpendicular to said horizontal surface of said object, said second end of said second coil spring engages with said horizontal surface of said object at an angle of about 60 degrees between said longitudinal axis of said member and said horizontal surface of said object, and said second end of said third coil spring engages with said horizontal surface of said object at an angle of about 30 degrees between said longitudinal axis of said member and said horizontal surface of said object.

8. The apparatus as recited in claim 1, wherein said linkage is comprised of a linkage arm operatively connected to said shaft of said mechanical timing mechanism and to said member.

9. The apparatus as recited in claim 1, wherein said linkage is comprised of a shaft coupling operatively connected to said shaft of said mechanical timing mechanism and to a hinge pin in said first hinge of said member.

10. An apparatus for closing a member against a substantially horizontal surface of an object, wherein said member comprises a first end and a second end thereby defining a longitudinal axis of said member, and wherein said first end of said member is hingably attached by a first hinge and a second hinge to said substantially horizontal surface and said second end of said member is separated from said substantially horizontal surface with said longitudinal axis at a non-perpendicular angle to said substantially horizontal surface, said apparatus comprising:

a. a mechanical timing mechanism comprised of a housing, and a rotatable shaft extending outwardly from said housing, said mechanical timing mechanism adapted for providing a torque upon said rotatable shaft and said mechanical timing mechanism operatively connected to said horizontal surface of said object;

b. a linkage operatively connected to said shaft of said mechanical timing mechanism and to said member, said linkage transmitting said torque applied by said mechanical timing mechanism on said rotatable shaft to provide a first force upon said member, said first force directed to bringing said longitudinal axis of said member from said non-perpendicular angle with said substantially horizontal surface to a perpendicular angle with said substantially horizontal surface;

c. an elongated shaft extending from said first hinge to said second hinge, said shaft having a central axis perpendicular to said longitudinal axis of said member;

d. a plurality of coil springs wound around said elongated shaft adapted for providing a second force upon said member that resists bringing said member into contact with said substantially horizontal surface, each of said coil springs including a first end engaged with said member, and a second end adapted for engagement with said horizontal surface of said object, wherein each of said second ends of said coil springs engages with said horizontal surface at a different angular position of said member during descent of said member to said horizontal surface of said object.

11. The apparatus as recited in claim 10, wherein said plurality of coil springs is comprised of a first coil spring and a second coil spring wound around said elongated shaft.

12. The apparatus as recited in claim 11, wherein said second end of said first coil spring is engaged with said horizontal surface of said object when said member is perpendicular to said horizontal surface of said object.

13. The apparatus as recited in claim 11, further comprising a third coil spring wound around said elongated shaft, said third coil spring including a first end engaged with said member, and a second end adapted for engagement with said horizontal surface of said object, wherein said second ends of said first coil spring, said second coil spring, and said third coil spring each engage with said horizontal surface at a different angular position of said member during descent of said member to said horizontal surface.

14. The apparatus as recited in claim 13, wherein said second end of said first coil spring is engaged with said horizontal surface of said object when said member is perpendicular to said horizontal surface of said object, said second end of said second coil spring engages with said horizontal surface of said object at an angle of about 60 degrees between said longitudinal axis of said member and said horizontal surface of said object, and said second end of said third coil spring engages with said horizontal surface of said object at an angle of about 30 degrees between said longitudinal axis of said member and said horizontal surface of said object.

15. The apparatus as recited in claim 10, wherein said linkage is comprised of a linkage arm operatively connected to said shaft of said mechanical timing mechanism and to said member.

16. The apparatus as recited in claim 10, wherein said linkage is comprised of a shaft coupling operatively connected to said shaft of said mechanical timing mechanism and to a hinge pin in said first hinge of said member.

17. An apparatus for closing a member against a substantially horizontal surface of an object, wherein said member comprises a first end and a second end thereby defining a longitudinal axis of said member, and wherein said first end of said member is hingably attached by a first hinge and a second hinge to said substantially horizontal surface and said second end of said member is separated from said substantially horizontal surface with said longitudinal axis at a non-perpendicular angle to said substantially horizontal surface, said apparatus comprising:

a. a mechanical timing mechanism comprised of a housing, and a rotatable shaft extending outwardly from said housing, said mechanical timing mechanism adapted for providing a torque upon said rotatable shaft and said mechanical timing mechanism operatively connected to said horizontal surface of said object;

b. a linkage operatively connected to said shaft of said mechanical timing mechanism and to said member, said linkage transmitting said torque applied by said mechanical timing mechanism on said rotatable shaft to provide a first force upon said member, said first force directed to bringing said longitudinal axis of said member from said non-perpendicular angle with said substantially horizontal surface to a perpendicular angle with said substantially horizontal surface;

c. an elongated shaft extending from said first hinge to said second hinge, said shaft having a central axis perpendicular to said longitudinal axis of said member;

d. a variable rate coil spring wound around said elongated shaft adapted for providing a second force upon said member that resists bringing said member into contact with said substantially horizontal surface, said variable rate coil spring wound around said elongated shaft and including a first end engaged with said member and a second end engaged with said horizontal surface of said object, and said variable rate coil spring providing said second force at a nonlinear rate as the angle formed between said member and said surface decreases.

* * * * *